US009604828B1

(12) United States Patent
Petricio Yaksic et al.

(10) Patent No.: US 9,604,828 B1
(45) Date of Patent: Mar. 28, 2017

(54) HEAVY EQUIPMENT LIFTING

(71) Applicant: Davor J. Petricio Yaksic, Antofagasta (CL)

(72) Inventors: Davor J. Petricio Yaksic, Antofagasta (CL); Davor A. Petricio Heredia, Antofagasta (CL); Daniel Montolio Cancino, Antofagasta (CL)

(73) Assignee: Davor J. Petricio Yaksic, Antofagasta (CL)

( * ) Notice: Subject to any disclaimer, the term of this patent is extended or adjusted under 35 U.S.C. 154(b) by 310 days.

(21) Appl. No.: 14/260,895

(22) Filed: Apr. 24, 2014

(51) Int. Cl.
*B66F 1/02* (2006.01)

(52) U.S. Cl.
CPC ..... *B66F 1/025* (2013.01)

(58) Field of Classification Search
CPC ..... B66F 1/04; B66F 1/08; B66F 1/02; B66F 1/00; B66F 1/06; B66F 1/025; B66F 9/00; B66F 11/00; B66F 3/00; B66F 3/30; B66F 3/24; B60P 3/035
USPC ..... 414/800; 254/100, 108; 52/111, 122.1
See application file for complete search history.

(56) References Cited

U.S. PATENT DOCUMENTS 593,864 A * 11/1897 Staudenmayer ..... B27F 7/006 227/111
3,881,687 A * 5/1975 Johansson ..... E02B 17/0863 254/1
4,032,112 A * 6/1977 Schmidt ..... E04G 11/28 254/108
4,067,448 A * 1/1978 Bergeron, Jr. ..... B66F 7/10 187/243
4,793,439 A * 12/1988 Crawford ..... B66F 1/025 182/136
5,335,468 A * 8/1994 Oberman ..... A63J 1/02 182/186.6
5,379,974 A * 1/1995 Slay ..... B66F 1/04 248/161
5,839,239 A * 11/1998 Jang ..... E04B 1/3511 254/93 R
2004/0200258 A1* 10/2004 Hess ..... B66F 7/0658 72/457
2010/0000955 A1* 1/2010 Nakamitsu ..... B66C 1/10 212/270

* cited by examiner

*Primary Examiner* — Michael McCullough
*Assistant Examiner* — Lynn Schwenning
(74) *Attorney, Agent, or Firm* — James Creighton Wray; Meera P. Narasimhan

(57) ABSTRACT

Heavy equipment is attached to slings and lifted by rollers raised and lowered in a structure with four pillars. Rollers prevent torque and provide vertical vectors. Roller axle supports move along the pillars. Two gantry crane frames are joined by cross and truss beams. Hydraulic jacks and pneumatic locks are controlled and sensed movements are communicated to processors for each pillar. One master processor communicates with a remote control. Sensors check lock and hydraulic cylinder position and allow roller movements only when positions are correct and all processors agree.

22 Claims, 15 Drawing Sheets

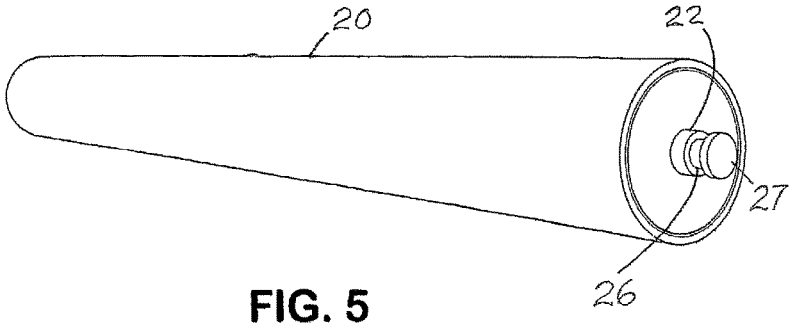
FIG. 5
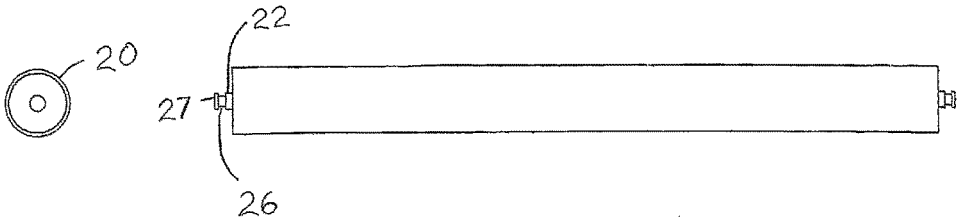
FIG. 7
FIG. 6

| States /cycle | Hydraulic System | Pneumatic System | | Electronic System | | | | | | | | |
|---|---|---|---|---|---|---|---|---|---|---|---|---|
| | Hydraulic Piston | Pneumatic Piston | | Upper Locked Sensor | | Upper Released Sensor | | Lower Locked Sensor | | Lower Released Sensor | | Hydr. Piston Half Step Sensor |
| | | Upper | Lower | Right | Left | Right | Left | Right | Left | Right | Left | |
| Moving Up | | | | | | | | | | | | |
| U0 / Initial position | Closed | Closed | Closed | Active | Active | Inactive | Inactive | Active | Active | Inactive | Inactive | Inactive |
| U1 | Openning | Closed | Closed | Inactive | Inactive | Inactive | Inactive | Active | Active | Inactive | Inactive | Active |
| U2 | Openning | Closed | Closed | Active | Active | Inactive | Inactive | Active | Active | Inactive | Inactive | Active |
| U3 | Closing | Closed | Closed | Active | Active | Inactive | Inactive | Inactive | Inactive | Inactive | Inactive | Inactive |
| U4 | Closing | Closed | Closed | Active | Active | Inactive | Inactive | Active | Active | Inactive | Inactive | Inactive |
| U5 / End of process | Closed | Closed | Closed | Active | Active | Inactive | Inactive | Active | Active | Inactive | Inactive | Inactive |
| | | | | | | | | | | | | |
| Moving Down | | | | | | | | | | | | |
| D0 / Initial Position | Closed | Closed | Closed | Active | Active | Inactive | Inactive | Active | Active | Inactive | Inactive | Inactive |
| D1 | Closing | Closed | Open | Active | Active | Inactive | Inactive | Inactive | Inactive | Active | Active | Inactive |
| D2 | Openning | Closed | Open | Active | Active | Inactive | Inactive | Inactive | Inactive | Active | Active | Active |
| D3 | Openning | Closed | Closed | Active | Active | Inactive | Inactive | Active | Active | Inactive | Inactive | Active |
| D4 | Openning | Open | Closed | Inactive | Inactive | Active | Active | Active | Active | Inactive | Inactive | Active |
| D5 | Closing | Open | Closed | Inactive | Inactive | Active | Active | Active | Active | Inactive | Inactive | Inactive |
| D6 | Closing | Closed | Closed | Active | Active | Inactive | Inactive | Active | Active | Inactive | Inactive | Inactive |
| D7 / End of process | Closed | Closed | Closed | Active | Active | Inactive | Inactive | Active | Active | Inactive | Inactive | Inactive |

FIG. 24

HEAVY EQUIPMENT LIFTING

BACKGROUND OF THE INVENTION

Lifting heavy equipment creates challenges and problems which must be solved. One of the problems, of course, is the heavy weight of the machinery. Another problem is unique sizes and shapes of heavy equipment that must be lifted. Another problem is dealing with torque that may be encountered when lifting heavy equipment.

Needs exist for improvements in heavy equipment lifting.

SUMMARY OF THE INVENTION

The invention provides apparatus and methods for lifting heavy equipment.

The apparatus has a structural frame. The structural frame has first and second open ends, first and second longitudinal sides and a top. Four spaced pillars are connected at intersections of the sides and ends. Cross beams are mounted at tops of the pillars at the first and second ends. Horizontal beams connect the cross beams at the top and connect the pillars at the sides. Truss beams connect the horizontal beams at angles on the top and the sides. The pillars are formed of two spaced parallel vertical channel beams with outward flanges. The channel beams are welded with interposed plates forming box beams with flanges. Plate assemblies are connected to two flanges on inner sides of the pillars for sliding along the inner sides of the pillars. The plate assemblies have inward facing long front plates extending parallel to aligned flanges of two channel beams. Two shorter back plates are bolted or welded to ends of each front plate to trap the aligned flanges between front and back plates. The front plates or both the front and back plates are grooved to receive the aligned channel flanges. The front plates have roller axle-supporting upward opening grooves in upper surfaces of the plate assemblies. First and lifting rollers have axles positioned in the axle-holding grooves in the upper front plates respectively at the first and second ends of the structure.

The rollers have cylinders with end plates at opposite ends, and the axles extend outward from the end plates. The rollers have cylinders with outer end plates and inner end plates, and the axles are welded to the inner end plates and extend through openings in the outer end plates.

The axles have annular grooves in ends of the axles opposite the end plates, and the annular grooves in the axles are held in the grooves in the upper front plates.

Slings extend over the roller and downward therefrom for connecting ends of the slings to an object to be lifted. The cylinders and piston rods are provided on axles intersecting the upper and lower plates. The front plates have extensions for mounting the pneumatic actuators.

The invention provides a method of lifting heavy equipment, such as mining equipment, by constructing a structural frame having first and second open ends, first and second longitudinal sides and a top. Four spaced pillars are provided at intersections of the sides and ends. Cross beams are provided at tops of the pillars at the first and second ends. Horizontal beams connect the cross beams at the top and connect the pillars at the sides. Truss beams connect the horizontal beams at angles on the top and the sides. Plate assemblies connect to the pillars for sliding along inner sides of the pillars. Roller axle-supporting upward opening grooves are provided in upper surfaces of the plate assemblies. First and lifting rollers have axles positioned in the axle-holding grooves in the upper front plates respectively at the first and second ends of the structure.

The rollers have cylinders with end plates at opposite ends, and the axles extend outward from the end plates. The rollers have cylinders with outer end plates and inner end plates, and the axles are welded to the inner end plates and extend through openings in the outer end plates. The axles have annular grooves in ends of the axles opposite the end plates, and the annular grooves in the axles are held in the grooves in the upper front plates.

Slings extend over the roller and downward therefrom for connecting ends of the slings to an object to be lifted and lifting the object with the slings.

In one form the apparatus of the invention has a structural frame with top, longitudinal sides and first and second open ends. The apparatus has four spaced pillars having pairs of opposite teeth parallel to the sides of the structural frame. The teeth in each pair are longitudinally spaced. The tops of the pillars have first and second cross beams at the first end and at the second end. Horizontal beams connect the cross beams at the top of the structural frame and connect the pillars at the sides of the structural frame. Truss beams connect the horizontal beams at angles on the top and the sides of the structural frame.

Climbing assemblies are mounted on insides of each of the pillars. Each of the climbing assemblies has upper and lower plate assemblies. Each plate assembly has front plates extending along an inner side of the teeth on a pillar and has back plates behind the teeth on the pillar. Each front plate in each of the upper plate assemblies has a roller axle-supporting groove in an upper surface of the front plate. Double-acting hydraulic cylinders and piston rods are mounted between the upper and lower front plates. Each double-acting cylinder is connected to one of the upper plates, and each cylinder has a piston rod connected to one of the lower front plates.

Sliding lock bolts herein described as locks are connected to the plates between the front plates and the rear plates of each plate assembly for selectively and concurrently engaging or disengaging the teeth from opposite directions and alternatively locking the upper plates and the lower plates with the locks and the teeth. Upper and lower pneumatic actuators are connected to the upper and lower plate assemblies and are connected to the locks for timely inserting and withdrawing the locks into and out from the teeth. Hydraulic lines are connected to upper and lower ends of the double-acting cylinders for raising the cylinders and the upper plates when hydraulic pressure is applied to the upper ends of the double-acting cylinders while the lower plates are locked with the teeth, and for raising the lower plates when hydraulic pressure is applied to the lower ends of the hydraulic cylinders while the upper plates are locked with the locks in the teeth. A control panel is connected to valves in the pneumatic lines and to valves in the hydraulic lines for sequencing.

The locks are inserted and all plate assemblies are locked with the pneumatic actuators. Locks are withdrawn in the upper plate assemblies into the teeth. Hydraulic pressure is admitted to upper ends of the hydraulic cylinders to raise the upper plate assemblies. Locks are inserted in the upper plate assemblies into the teeth. Locks are withdrawn in the lower plate assemblies from the teeth. Hydraulic pressure is admitted to lower ends of the hydraulic cylinders and raising the lower plate assemblies.

First and lifting rollers have axles positioned in the axle-holding grooves in the upper front plates respectively at the first and second ends of the structure. The rollers have cylinders with end plates at opposite ends, and the axles extend outward from the end plates. The rollers have cylinders with outer end plates and inner end plates, and the axles are welded to the inner end plates and extend through openings in the outer end plates.

The axles have annular grooves in ends of the axles opposite the end plates, and the annular grooves in the axles are held in the grooves in the upper front plates.

Slings extend over the roller and downward therefrom for connecting ends of the slings to an object to be lifted. The cylinders and piston rods are provided on axles intersecting the upper and lower plates. The front plates have extensions for mounting the pneumatic actuators.

The apparatus has sensors on the pillars, pneumatic actuators and hydraulic systems for sensing positions of engaged or disengaged locks. The pneumatic actuators have double-acting cylinders with pistons and piston rods connected to the locks. The sensors on the pneumatic actuators sense position of the pistons within the pneumatic cylinders, and the sensors on the hydraulic systems sense pressure on the hydraulic lines and overforce the hydraulic cylinder and piston for over closing or over opening. The sensors on the cylinders and lower plate assemblies sense half travel of the cylinder with respect to the lower plate assemblies for admitting pressure to the pneumatic cylinders to advance the locks for engagement with the teeth.

These and further and other objects and features of the invention are apparent in the disclosure, which includes the above and ongoing written specification, with the claims and the drawings.

BRIEF DESCRIPTION OF THE DRAWINGS

FIG. 5 is a perspective view of a heavy load support roller shown in FIGS. 1-4.

FIG. 6 is a side view of the load support roller shown in FIG. 5.

FIG. 7 is an end view of the load support roller shown in FIGS. 5 and 6.

FIG. 24 is a chart of checks and operation of hydraulic and pneumatic systems.

DETAILED DESCRIPTION

Figure 1:
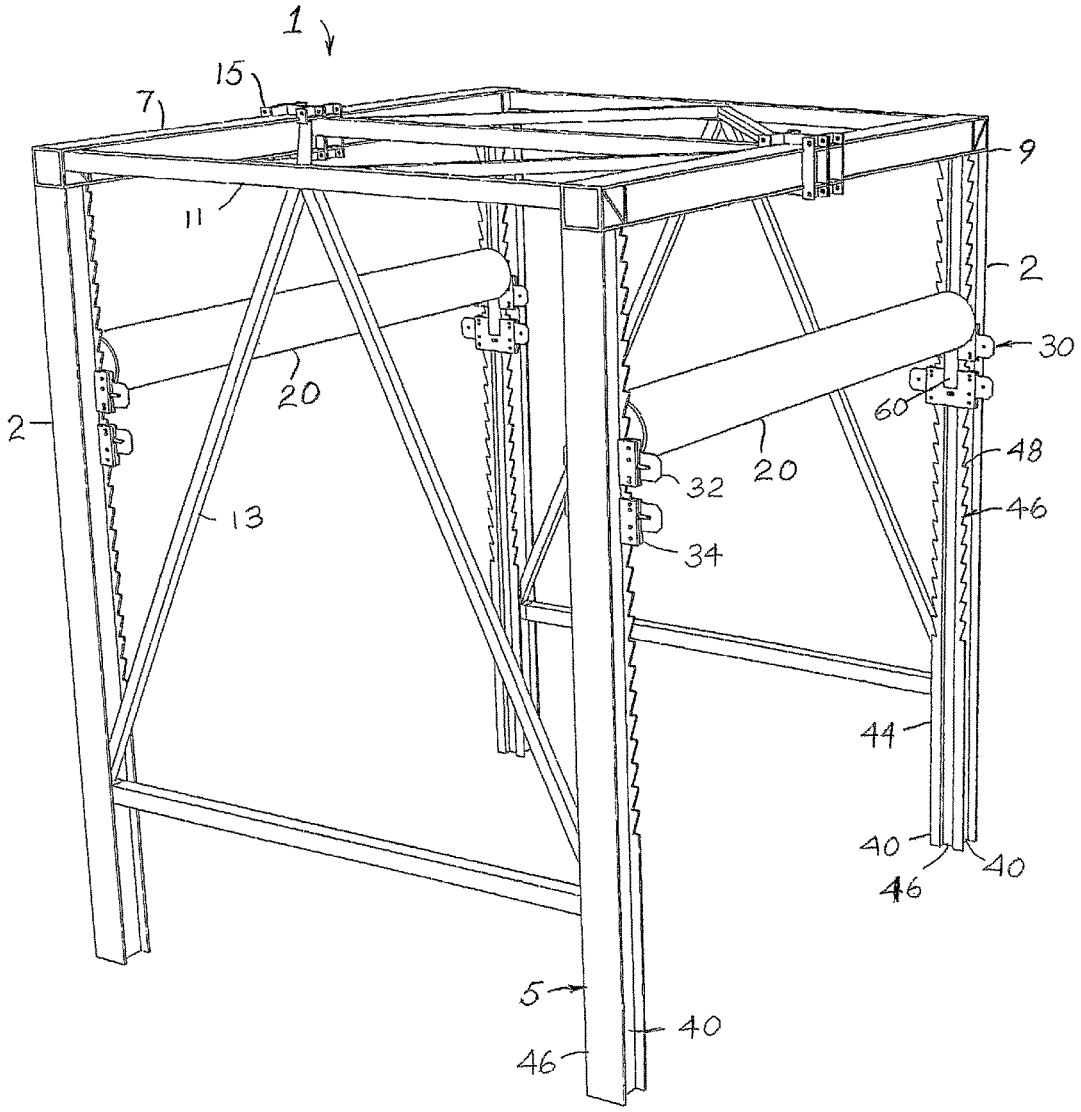
FIG. 1 is a perspective view of a frame structure having pillar-supported movable rollers for raising and lowering.

The frame structure 1 has two gantry crane structures 2 at its first and second ends 3 and 4. Each gantry crane 2 has pillars 5 and a large cross beam 7 at the tops 9 of the pillars. The pillars 5 and cross box beams 7 are joined by horizontal beams 11 and truss beams 13. The cross beams 7 have joint chairs 15 where other horizontal beams and truss beams may be joined.

Rollers 20 between pillars 5 are supported between roller raising assemblies 30.

As shown in FIG. 1, the roller-raising assemblies 30 have upper plate anchor subassemblies 32 and lower plate anchor assemblies 34. Hydraulic cylinders 60 and pistons 62 are actuated to separate plate anchor subassemblies 32 and 34 and to bring them together.

The pillars 5 are specially formed oppositely opening channel beams 40 spaced by welded plates 42. Inward facing flanges 44 of the channel beams have teeth 46 milled therein. The teeth have flat upper edges 48 and outward sloped lower edge surfaces.

The channel beams are about ¾ inch thick and about 15 to 20 inches wide at their bases. Their flanges are about 5 to 7 inches in width.

The box beams 7 at the tops 9 of the pillars 5 are about 15 to 20 inches wide and about ½ inch thick. The horizontal beams 11 are square or round beams about 6 inches in diameter and ¼ inch thick. The truss beams are about 4 or 5 inches in width and about ¼ inch thick. Gussets (not shown) are welded to the horizontal beams and truss beams which are joined by bolts. The bolts are used for assembly and disassembly and for replacement with longer or shorter beams to change the length of the lifter 1. The box beams 7 are welded to tops 9 of the pillars 5.

Figure 2:
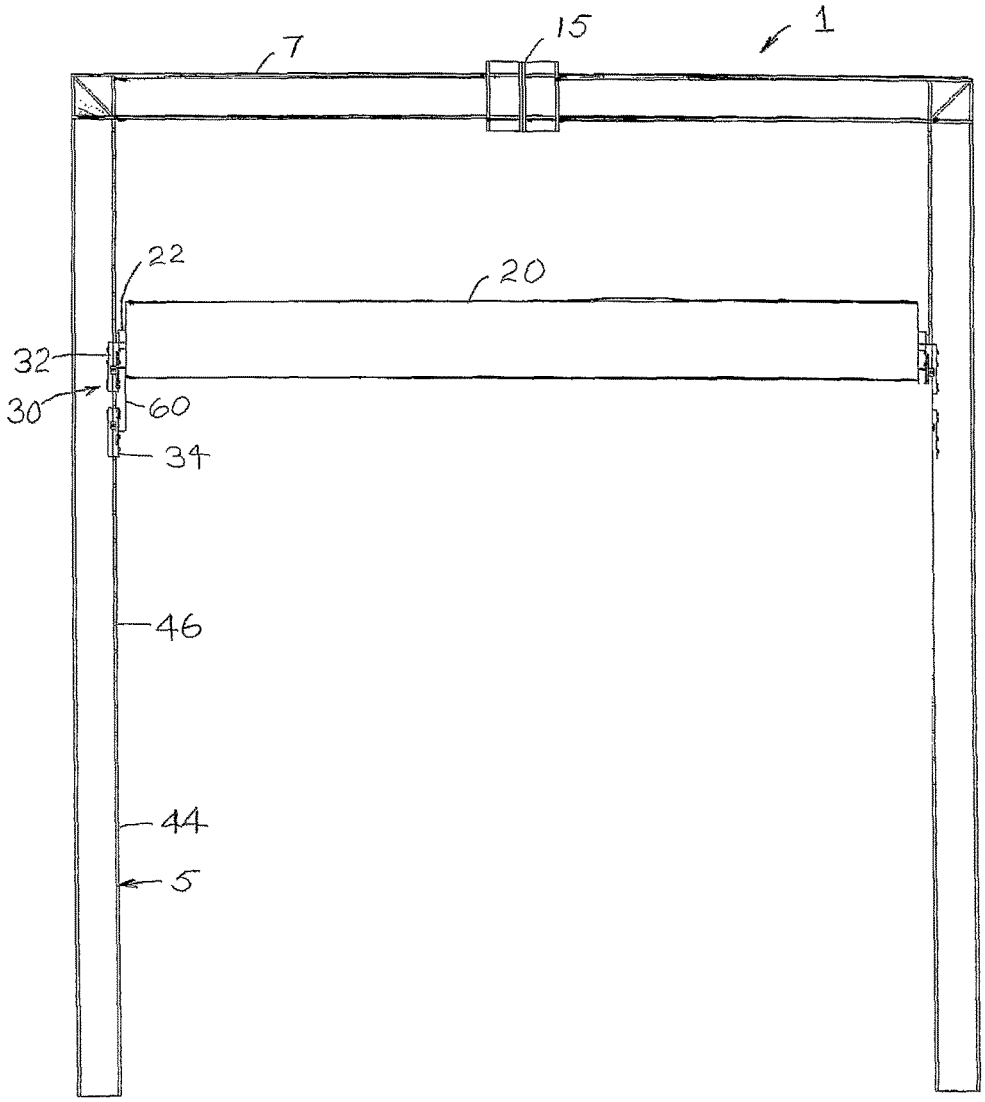
FIG. 2 is an end view of the frame structure shown in FIG. 1.

FIG. 2 is an end view of the frame structure shown in FIG. 1. The end view shows pillars 5 and a large cross beam 7 welded to tops 9 of the pillars. The beam-attaching chair 15 is shown on the cross beam 7. Edges of teeth 46 on the inner flanges 44 of the end channel beams 40 are shown. Roller 20 with axles 22 is supported on upper anchor assembly 32 of raising assembly 30. Teeth 46 on the inner flanges 44 are engaged by locks pneumatically positioned in engagement or out of engagement with the teeth.

Figure 3:
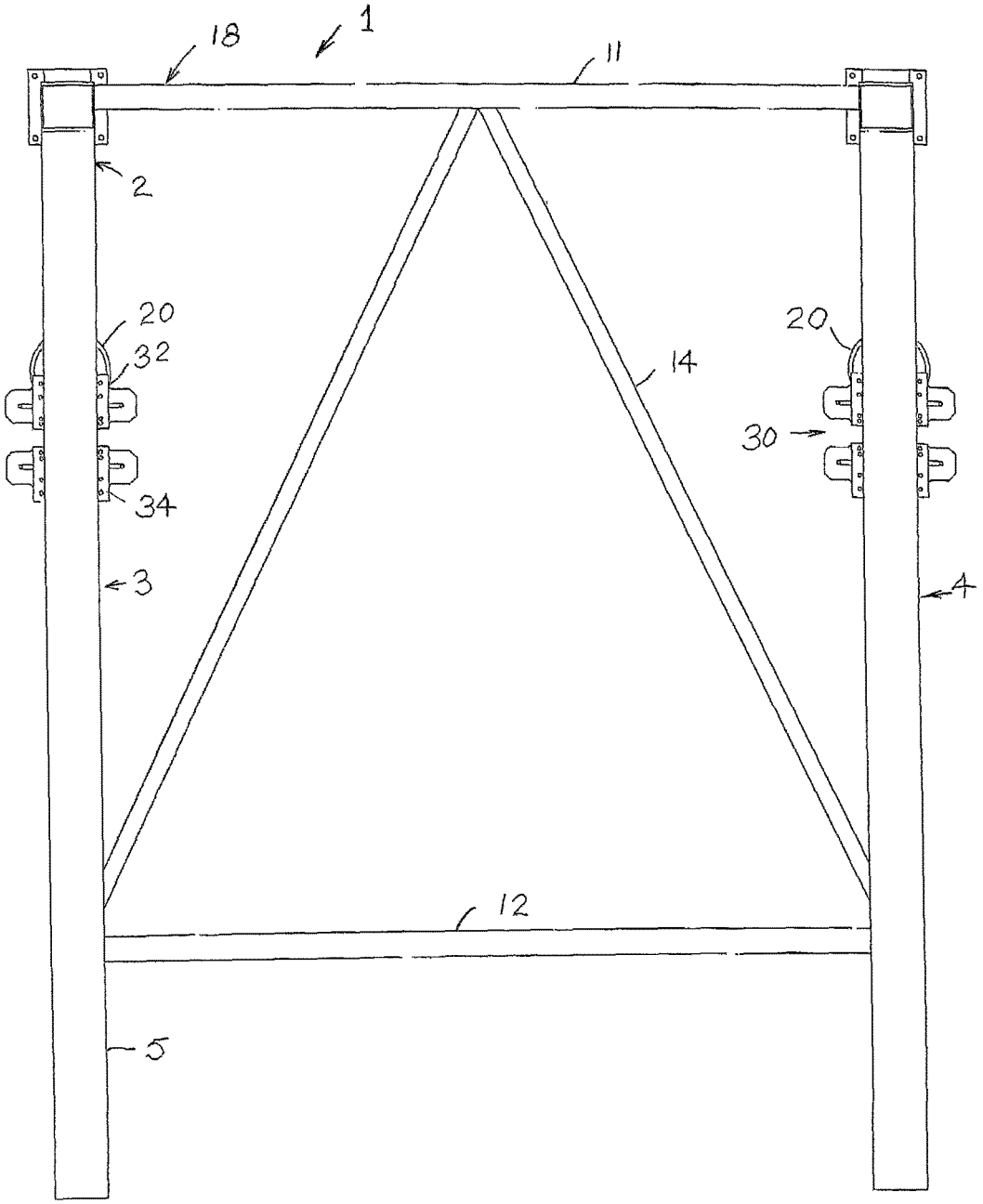
FIG. 3 is a modified side view of the frame structure shown in FIG. 1.

FIG. 3 is a modified side view of the frame structure shown in FIG. 1. The frame structure 1 and the gantry crane structures 2 at the ends 3 and 4 are shown. The lower horizontal beam 12 and truss beams 14 are used on both opposite sides 16, 17. Similar rigidifying beams are used at the top 18 of the structure between the horizontal beams 11.

Ends of the large rollers 20 and the raising assembly 30 with the upper and lower anchor assemblies 32, 34 are shown in FIG. 2. The pillars 5, the large cross box beams 7 with the central beam connecting chairs 15 are also shown.

Figure 4:
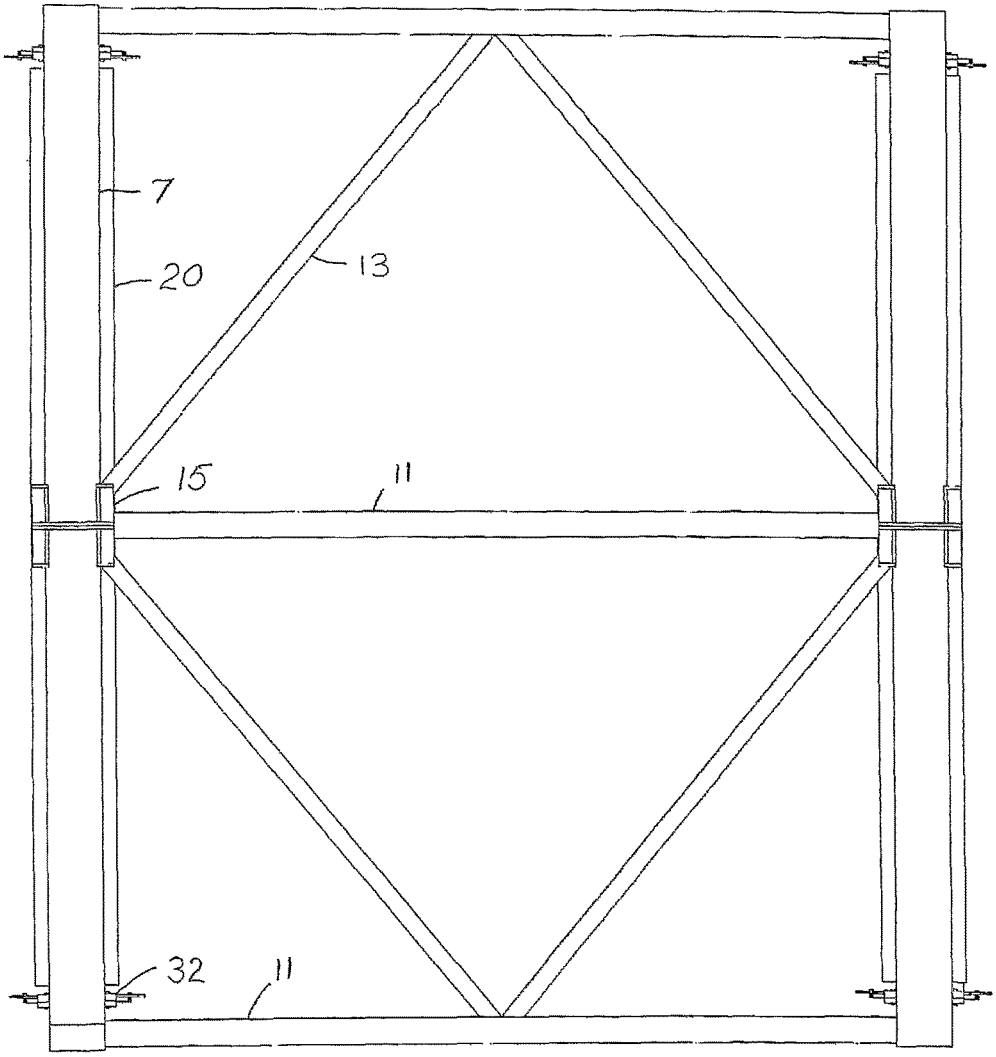
FIG. 4 is a top view of the frame structure shown in FIG. 1.

FIG. 4 is a top view of the frame structure shown in FIG. 1. The top view shows the large cross beams 7 at ends 3 and 4 and the rollers 20 below and centered on the raising assemblies 30 below the cross beams 7. The beam-connecting chairs 15 are shown at the centers of the cross beams. The horizontal beams 11 are connected to the cross beams 7. The truss beams 13 are connected to the chairs 15 and to the horizontal beams 11 at the sides 16 and 17.

FIG. 5 is a perspective view of a heavy load support roller shown in FIGS. 1-4. FIG. 6 is a side view of the load support roller shown in FIG. 5. FIG. 7 is an end view of the load support roller shown in FIGS. 5 and 6. FIGS. 5, 6 and 7 show perspective side and end views of roller 20 and axle 22 which extend from end plates 25 welded in the thick cylindrical rollers. The roller axles have grooves 26 near outer ends 27 of the axles 22. The grooved portions of the axles fit in upward opening grooves in the tops of the lifting and lowering assemblies 30 shown in FIGS. 1-4.

Figure 10:
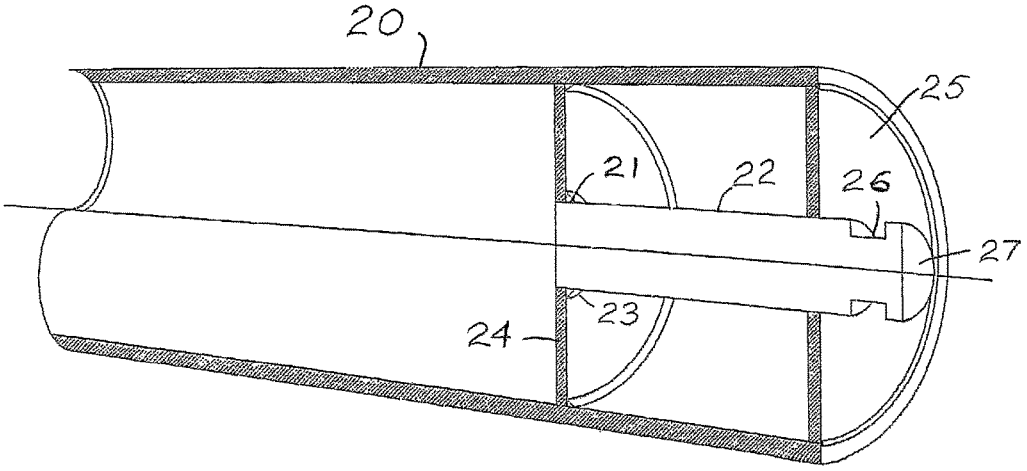
FIG. 10 is a perspective cross-sectional detail of the load support roller.
Figure 9:
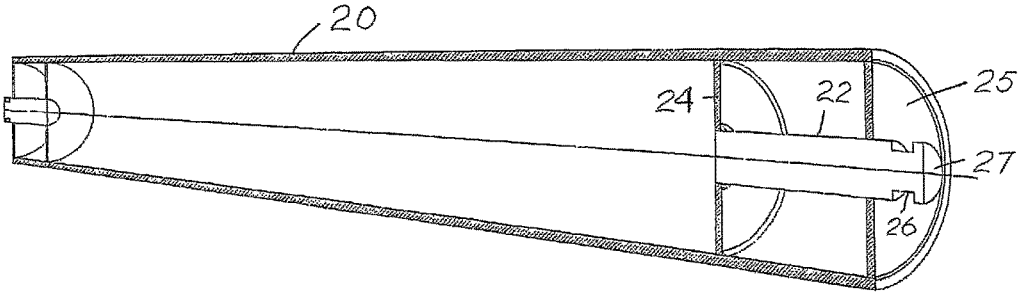
FIG. 9 is a perspective cross-sectional view of the load support roller.
Figure 8:
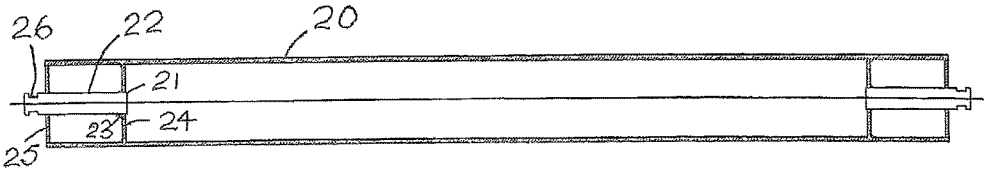
FIG. 8 is a cross-section of the load support roller as shown in FIG. 7.

FIG. 8 is a cross-section of the load support roller as shown in FIG. 7. FIG. 9 is a perspective cross-sectional view of the load support roller. FIG. 10 is a perspective cross-sectional detail of the load support roller. Roller 20 has short support axles 22 at opposite ends. Inner ends 21 of the support axles 22 are welded 23 in inner plates 24, which are welded inside the rollers 20. The axles 22 pass through central holes of outer plates 25 without being welded. The outer plates 25 are welded in ends of the roller 20. The non-welding of the axles in the outer plates 25 prevents stress cracks which might form if the axles 22 were welded in the outer plate central holes. Grooves 26 are formed near the outer ends 27 of the axles 22. The grooves keep the axles aligned and engaged in upward opening-receiving grooves in the roller raising and lowering assemblies 30 shown in FIGS. 1-4.

Figure 11:
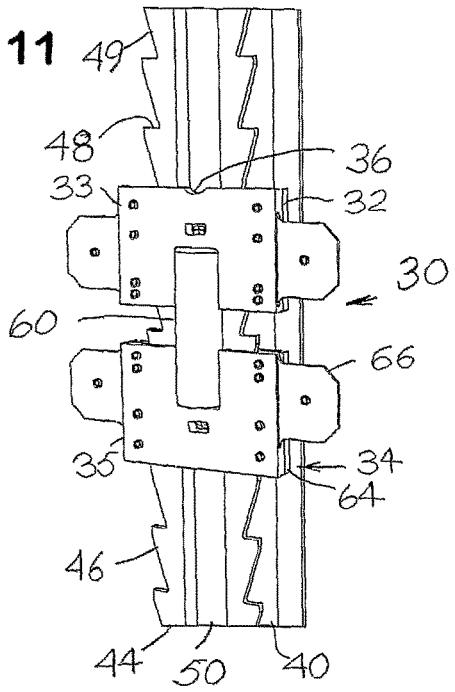
FIG. 11 is a perspective detail of a roller end raising assembly on a pillar.
Figure 14:
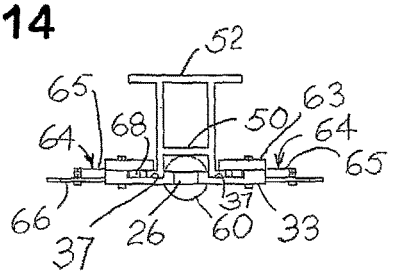
FIG. 14 is a top view of the pillar and the roller raising assembly shown in FIGS. 11-13.

FIG. 11 is a perspective detail of a roller end raising assembly on a pillar. Pillar 5 is made from channel beams 40 that are welded to plates 50 and 52. Before welding, teeth 46 are milled in one flange 44 of each channel beam. The teeth 46 have flat upper ledges 48 and upward and outward sloping edges 49 which lead to the ledges 48. The channel beams 40 are spaced back-to-back and are welded in the spaced relationship to plates 50 and 52. Plate 50 is spaced inward from toothed flanges 44 of the channel beams 40 to accommodate cylinders 60.

Cylinders 60 and pistons 62 have vertical axes which are aligned with centers of inward facing upper and lower plates 33 and 35.

FIGS. 11-14 are perspective front, side and top views of the pillar and the roller raising assemblies 30 shown in FIGS. 1-4.

Figure 12:
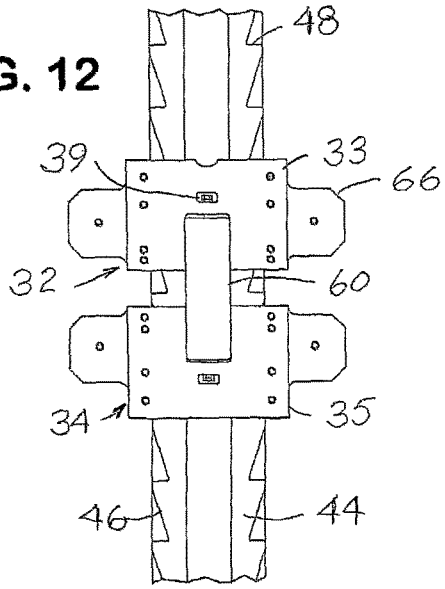
FIG. 12 is a front elevational detail of the assembly shown in FIG. 11.
Figure 13:
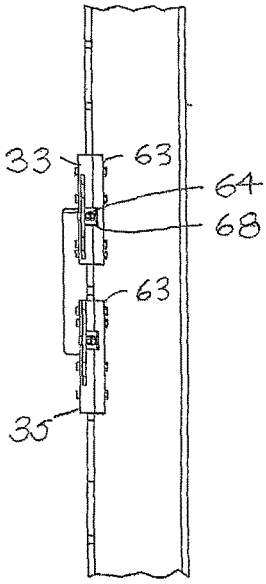
FIG. 13 is a side detail of a pillar and the roller raising assembly shown in FIGS. 11 and 12.

Inward facing upper plates 33 have upward opening grooves 36 which receive grooves 26 near outer ends of axles 22 in rollers 20. Cylinders 60 are fixed in the inward facing upper plates 33, and pistons 62 are fixed in the inward facing lower plates 35. Grooves 39 are formed in plates 33 and 35 to receive nuts which fasten threaded central ends of the cylinders and pistons to the plates. Backing plates 63, as shown in FIGS. 11-13, are bolted to the outward facing plates 33 and 35 to hold the upper and lower anchor assemblies 32 and 34 on the toothed flanges 44 of the pillars 5. The front plates have grooves 37 which receive the flanges 44 of the channel beams 40.

Double-acting pneumatic actuators 64 advance or withdraw locks 68. Pneumatic actuators 64 have cylinders 65 mounted on plates 66 welded to the upper and lower front plates 33 and 35. Ends of the pneumatic cylinders 65 are bolted to the plates 66. Inner ends of the cylinders 65 are held horizontally between the front plates and backing plates. Pistons are connected to locks 68. Locks 68 slide in grooves between the plates. Locks 68 are extended to overlie ledges 48 of teeth 46 in channel beam flanges 44. Locks 68 are withdrawn by the cylinders 65 and pistons before moving one of the upper or lower assemblies 32 or 34.

The cylinder end and lock grooves are larger in the thicker front plates and smaller in the backing plates so that the cylinders, pistons and locks are centered on the locking teeth 46 of the channel beam flanges 44.

Locks 68 are withdrawn into the grooves between front and backing plates when the pneumatic actuators 64 withdraw the locks. The locks 68 fully extend and partially extend from the grooves when the locks engage the teeth ledges 48. When the locks are extended, more of the locks are in the grooves between the front and back plates, and a lesser part of the locks extends out from the plate. In an example, when a lock is engaged, one-third of each lock extends out of the plates, and two-thirds of the lock is retained in the plates' grooves.

Figure 15:
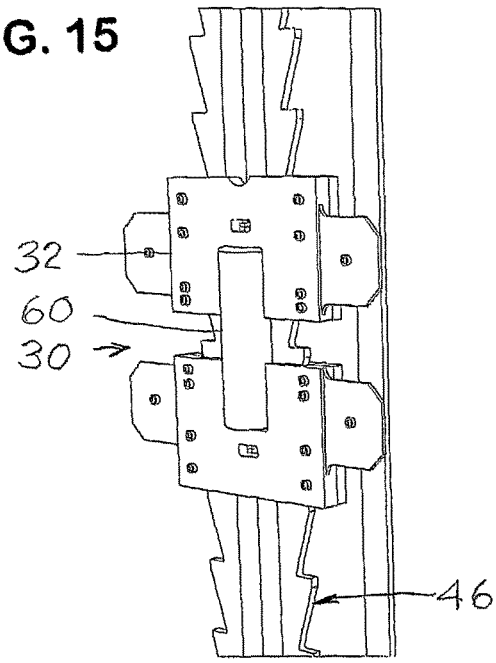
FIGS. 15 and 16 are perspective and front views of roller raising assemblies before actuating.
Figure 16:
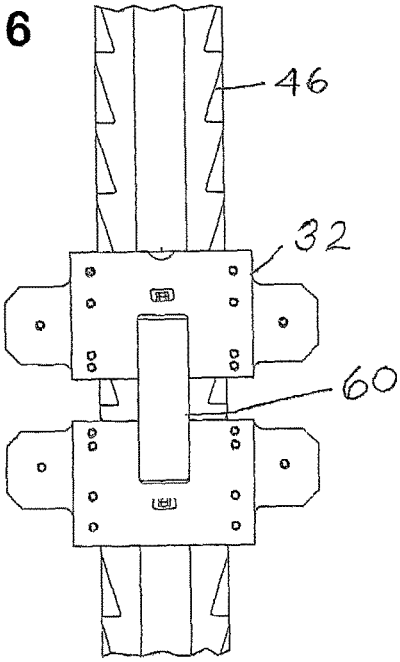

FIGS. 15 and 16 are perspective and front views of roller raising assemblies before actuating.

FIGS. 15 and 16 show the lifting and lowering assembly 30 close together before raising the upper assembly 32.

Figure 17:
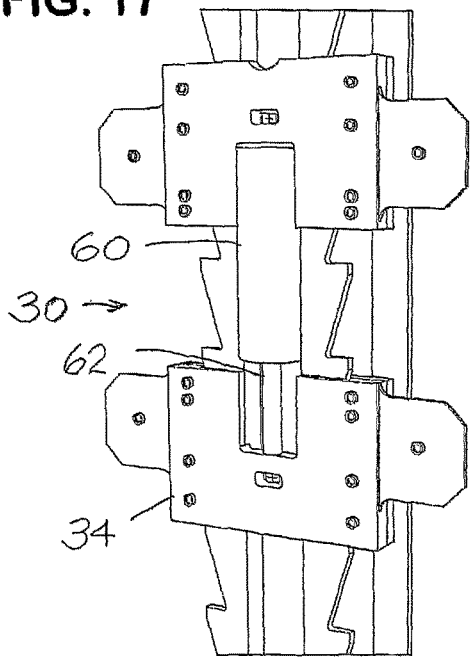
FIGS. 17 and 18 are perspective and front views of roller raising assemblies after raising a roller.
Figure 18:
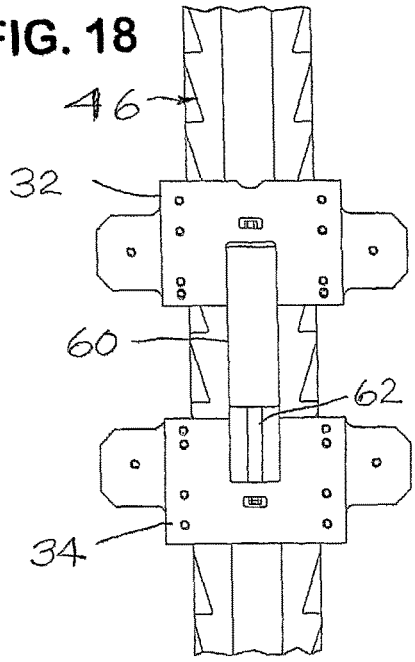

FIGS. 17 and 18 are perspective and front views of roller raising assemblies after raising a roller before raising the upper assembly 32. FIGS. 17 and 18 show the lifting and lowering assembly 30 extended. Cylinder 60 is connected to the upper assembly 32, and piston 62, as shown in FIGS. 17 and 18, is connected to the lower assembly 34.

In FIGS. 15 and 16 all of the locks are extended into the teeth 46. To raise the upper assembly 32, locks in the upper assembly are withdrawn from the teeth 46 and hydraulic pressure is introduced at the upper end of the double acting cylinders 60. The upper assembly is pushed upward, and then the locks in the upper assembly are engaged.

To move the lower assemblies 34 up from the position shown in FIGS. 17 and 18, locks in the lower assembly 34 are withdrawn from the teeth 46, and hydraulic pressure is introduced into lower ends of the double-acting cylinders 60. When the lower assembly 34 has been drawn upward to the upper assembly 32 by piston 62, locks in the lower assembly are inserted into the teeth 46. The movements are repeated to lift the assemblies 30 upward to the desired level.

Figure 19:
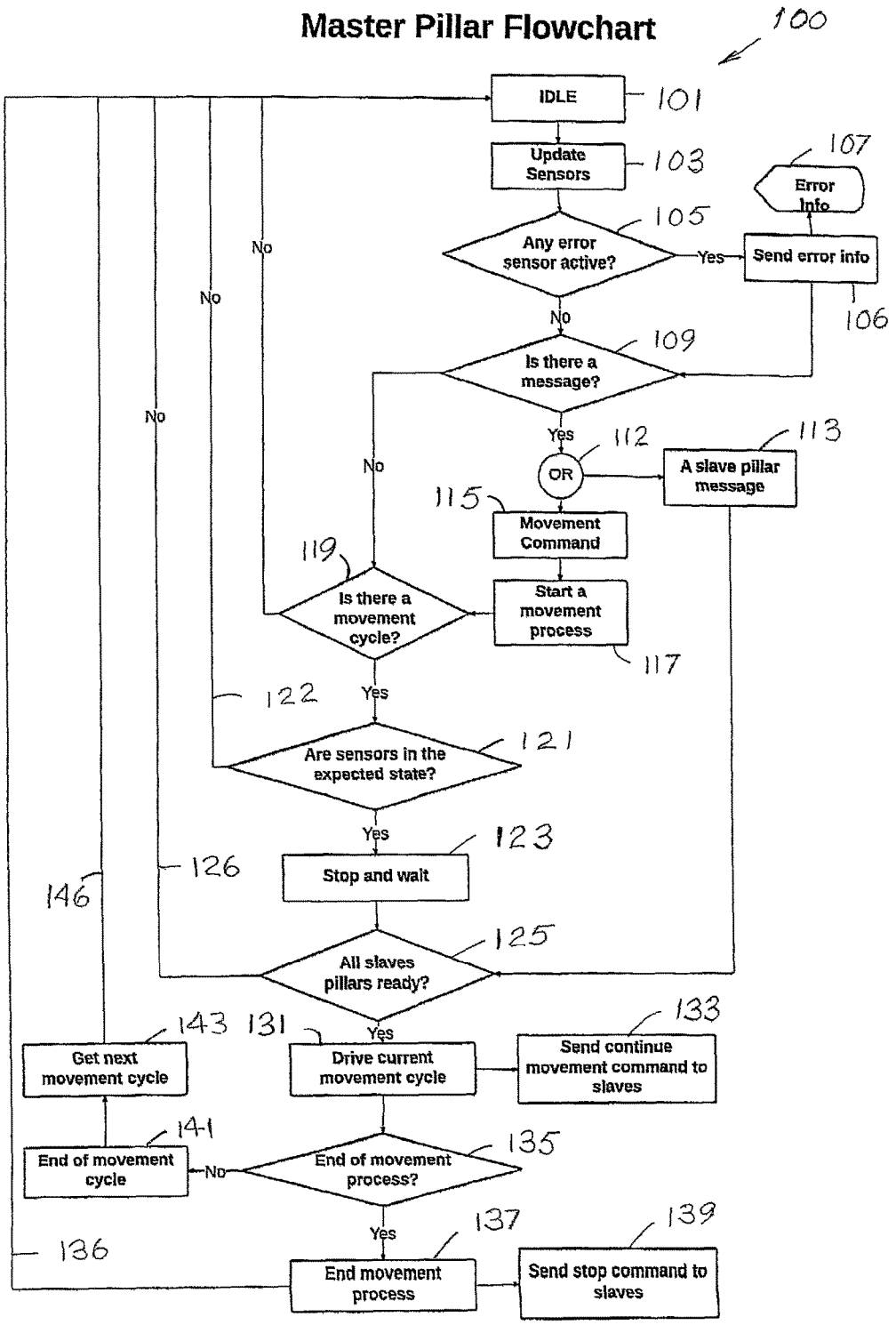
FIGS. 19 and 20 are flow charts of roller raising cylinder checking.
Figure 20:
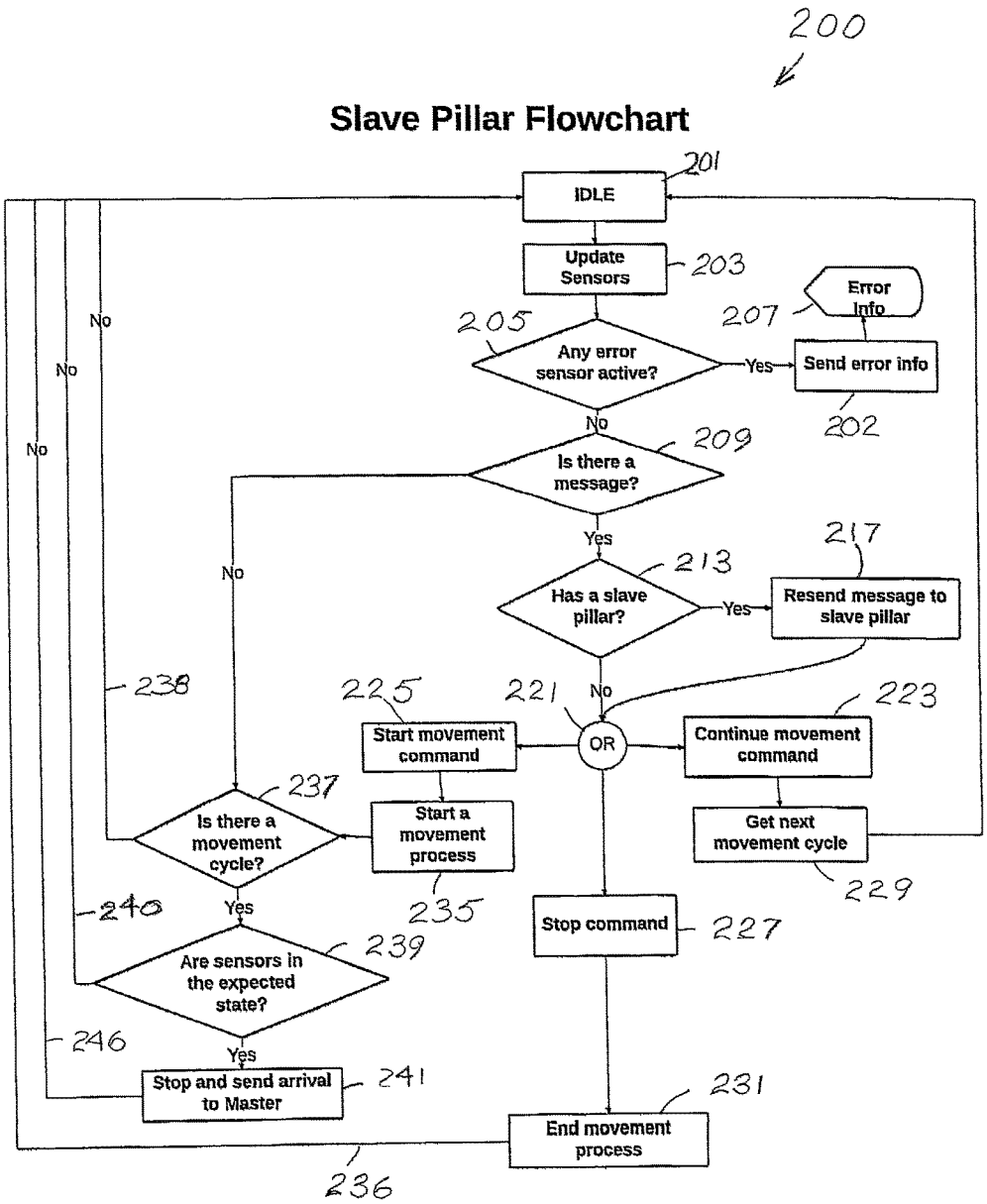

FIGS. 19 and 20 are flow charts of roller raising cylinders and lock position sensing and checking. Each structure has four or more pillars 5. One of the pillars is designated a master pillar. The master pillar has communications with the other pillars.

As shown in FIG. 19, the master pillar flow chart 100, the system is idle 101, meaning all locks are engaged, and valves of the pneumatic and hydraulic lines are closed. All sensors are checked and updated 103 for correct positions and readings. If an error is found, an error checker 105 sends error information 106 to an error information 107. If no error is present, a message checker 109 checks for a message. If a message is present 111, an OR gate 112 sends a slave pillar message 113. A movement command 115 and starts a movement process 117. If the checker 119 finds no message from a slave pillar, and a start movement 117 is in process, checker 121 checks that all sensors are in expected state. If not, the system is returned 122 to idle 101. If all sensors are in expected state, the system stops and waits 123.

Checker 125 checks that all slave pillars are ready. If not, the system 126 returns to idle 101. If all slave pillar are ready, a drive current movement cycle 131 is started and a continue movement command 133 is sent to slaves.

A checker 135 checks whether the end of a movement process has occurred.

If the end of a movement process has occurred, an end of movement process 137 sends a stop command 139 to all slaves and returns the system to idle 101.

If the end of a movement process has occurred, an end of movement cycle command 141 is sent to get the next movement cycle 143 and the system returns 136 to idle 101. If an end of movement process has not occurred, a no end of movement cycle 141 sends a signal to get the next movement cycle 143 which is sent 146 to idle 101.

A slave pillar flow chart 200 is shown in FIG. 20. All systems in a slave pillar start at idle 201.

As shown in FIG. 20, the slave pillar flow chart 200, the system starts at idle 201, meaning all locks are engaged, and valves of the pneumatic and hydraulic lines are closed. All sensors are checked and updated 203 for correct positions and readings. If any error sensor is active, an error checker 205 sends error information 202 to an error control 207. If no error is present, a message checker 209 checks for a message.

Checker 213 checks 215 for a further slave pillar. If yes, there is a slave pillar, the message is resent 217 to the slave pillar. If there is no further slave pillar or no message has been resent, a gate 221 continues a command movement 223, starts 225 a movement command or stops 227 a command. Continuing a movement command 223 gets to the next movement cycle 229 and readies the system for the next movement by returning to idle 201.

If the movement stop command 227 is made, an end movement process 231 returns 236 the system to idle 201.

If a start movement command 225 starts a movement process 235, checker 237 checks if there is a movement cycle from 235 and no message. If there is no message and no start a movement process, a signal 238 is returned to idle 201. All sensors are checked 239 to determine they are in expected states. If not, a signal 240 is returned to idle 201. If yes, the slave stops, sends an arrival message 241 to the master pillar control that all slaves are ready and returns 246 the pillar control to idle 201.

Figure 21:
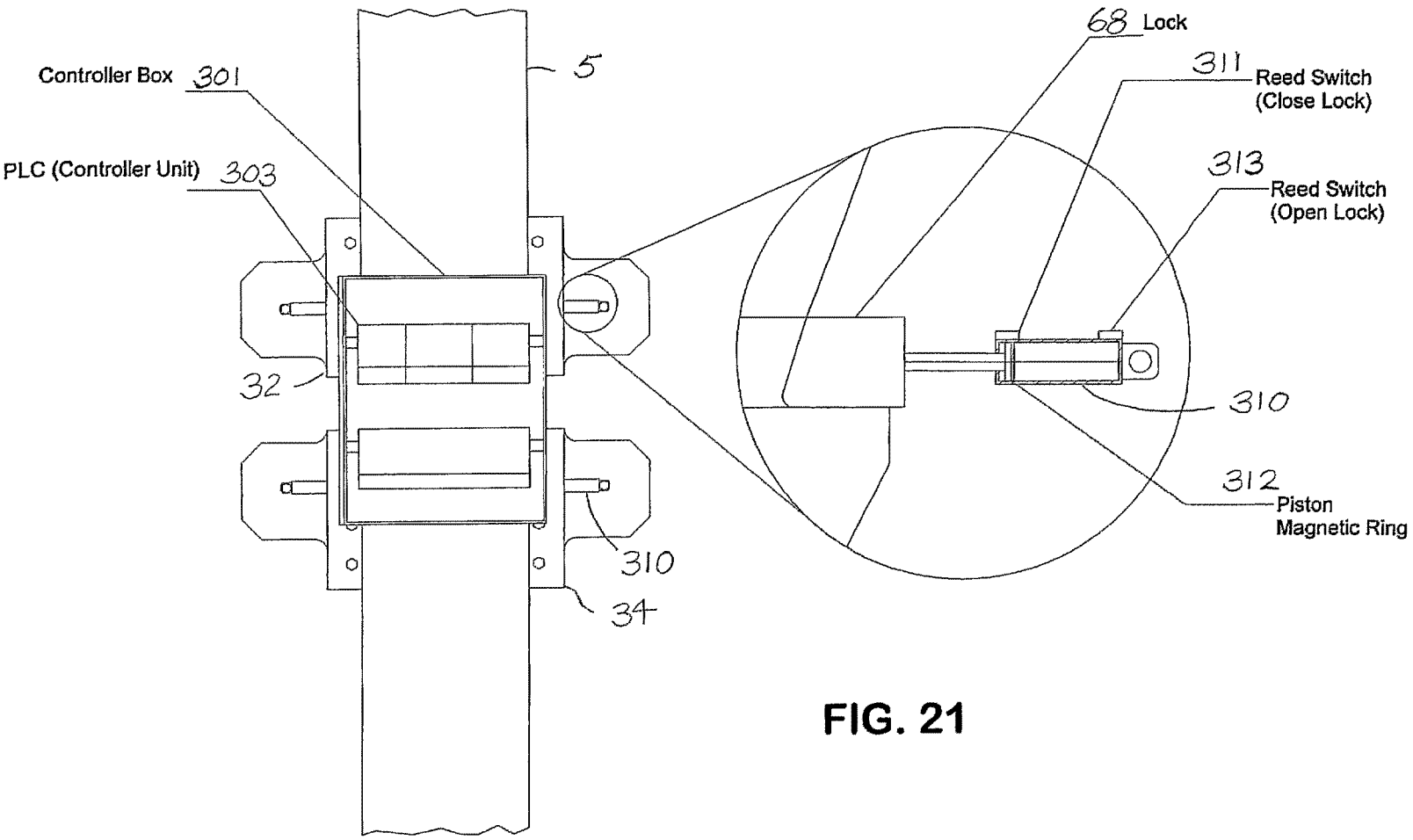
FIG. 21 is a representation of lock position sensing and control.

FIG. 21 is a representation of lock position sensing and control. A controller box 301 is mounted on a flat outside of a pillar 5. PLC controller units 303 are mounted within the box.

Sensors 311 and 313 are mounted on double-acting pneumatic cylinders 310 that move the locks 68. Magnetic sensors 311 and 313 are read switches which sense the internal position of a piston 312 with a magnetic ring. Sensor 311 senses when lock 68 is fully extended into engagement with a tooth ledge 48. Sensor 313 senses when the lock is fully withdrawn from engagement with teeth 46.

There are four locks, four cylinders and eight sensors on each pillar 5.

Figure 23:
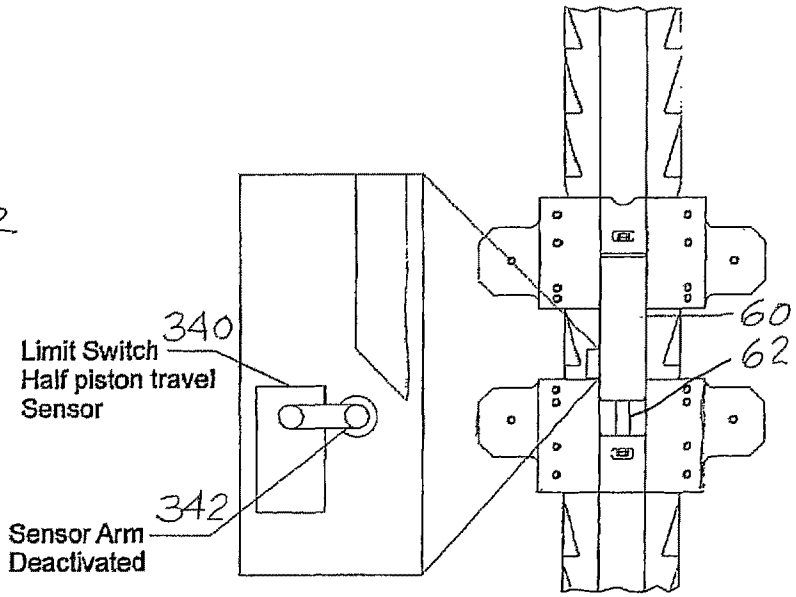
FIGS. 22 and 23 are representations of cylinder half travel sensors for controlling pneumatic valves.
Figure 22:
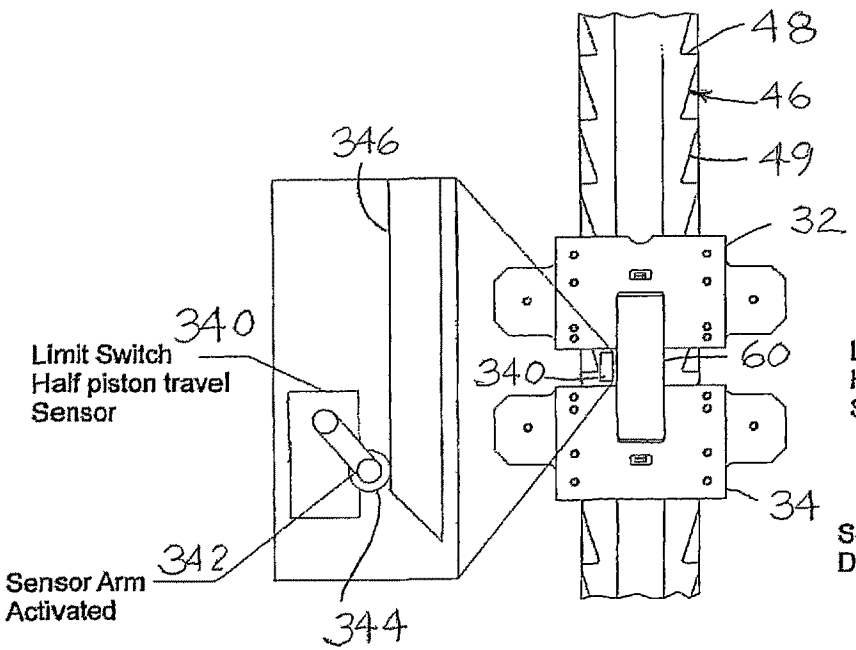

FIGS. 22 and 23 are representations of cylinder half travel sensors for controlling pneumatic valves. FIGS. 22 and 23 show switches 340 with sensor arms 342 having rollers 344 for contacting indicators 346 attached to the hydraulic roller raising and lowering cylinders. As shown in FIG. 22, the roller 344 is in contact with the cylinder-attached indicator. The activation of the sensor arm 342 signals that the hydraulic cylinder is in a position that an associated valve should be opened and that air should be admitted to the outer ends of the pneumatic cylinder to push the lock 68 inward. The lock 68 may be over a ledge 48 of the teeth or in contact with the slope 49 leading to a ledge.

When the hydraulic cylinders are halfway in their upward or downward travel, the indicators 346 cause the sensor arms 342 to be deactivated to permit the supply of pressurized air to outer ends of cylinders 310 (FIG. 21) to push the locks inward.

Each pillar 5 has its own control box with a processor, one solenoid-operated three-position hydraulic fluid valve, two two-position pressurized air valves that also are solenoid operated, and electrical sensor connections. Each pillar 5 has one double-acting lifting and lowering hydraulic cylinder and four pneumatic cylinders on one two-part raising and lowering assembly. Each pillar 5 has sixteen sensors. Eight sensors sense positions of the pistons in the four pneumatic cylinders and therefore the positions of the locks 68 attached to their piston rods.

One sensor senses the middle position of the hydraulic cylinder and piston extension. One sensor senses sufficiency of hydraulic pressure at the valves. One sensor senses sufficiency of pneumatic pressure at the valves. One sensor senses height of the lower raising and lowering assembly. One sensor senses height of the upper raising and lowering assembly.

Upper and lower limit switch sensors are connected to the raising and lowering assembly to limit movement of the hydraulic piston with relation to the cylinder.

One complete hydraulic system with a motor, pump, tank and relief is connected to each pillar. Two hydraulic lines, a high pressure line and a return line to the tank, are connected to the three-way hydraulic fluid valve in the pillar control box.

A single high pressure air system with a compressor, a pressurized tank and a pressure controller is provided for the entire structure. One pressurized air line leads from the pressurized air tank to each pillar control box. The pillar control box has a pressure regulator and oil mister which provides pressurized air to two two-way solenoid-operated valves. Two lines lead from a first two-way valve to the upper lifting assembly. Two lines lead from the second valve to the lower lifting assembly. Near the pneumatic cylinders each of the two lines is split. One line is split and connected to outer ends of the pneumatic cylinders. The other of the two lines is split for connections to inner ends of the pneumatic cylinders. The two-position valves either supply or exhaust pressurized air to or from opposite ends of the pneumatic cylinders.

Locking support wheels may be attached to the bottoms of the pillars to relocate the lifting structure.

FIG. 24 is a chart showing stages or states of the cycles of the hydraulic and pneumatic valves in five states for upward movement "U" to raise the rollers and loads and six states "D" for downward movement to lower the rollers and loads.

Figure 25:
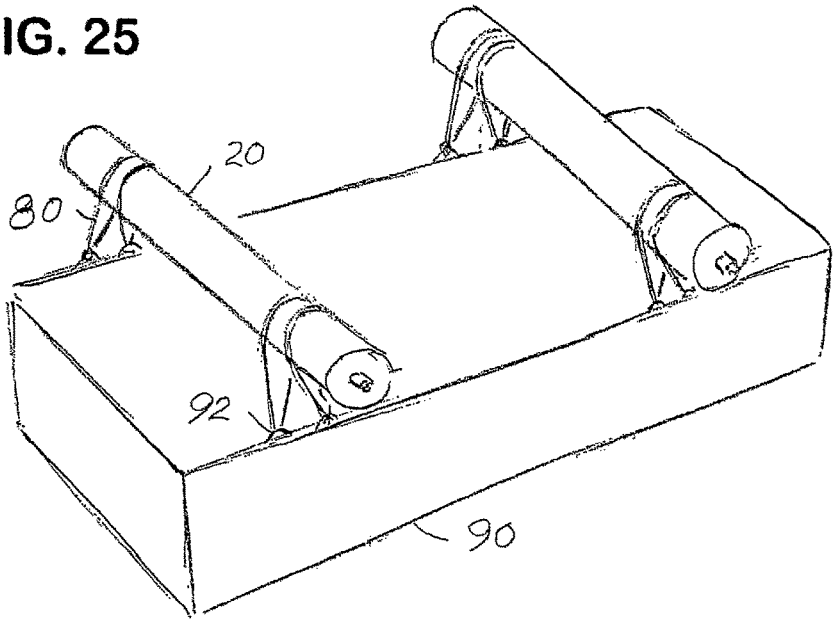
FIGS. 25 and 26 show connections between the lifting rollers and the loads to be lifted.
Figure 26:
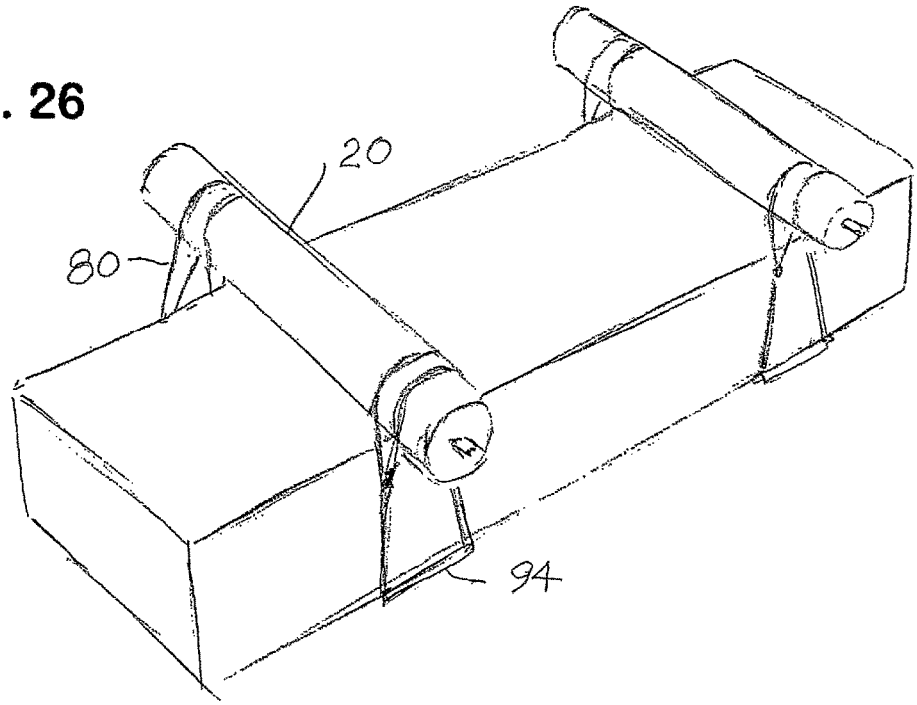

FIGS. 25 and 26 schematically show connections between the lifting rollers and the loads to be lifted.

Slings 80 are placed around rollers 20 that are mounted in the frame structure 1 between pillars 5, as shown in FIG. 1. The slings are attached to lifting points 92 on load 90, as shown in FIG. 2. Alternatively, the slings 80 are attached to the plates 94 below the load 90 or pass under the loads, as shown in FIG. 26.

The slings 80 may be steel ropes or cables, braided straps, chains or high tensile composite material. Examples of the heavy loads that may be lifted are large mining machines and sections thereof.

Figure 27:
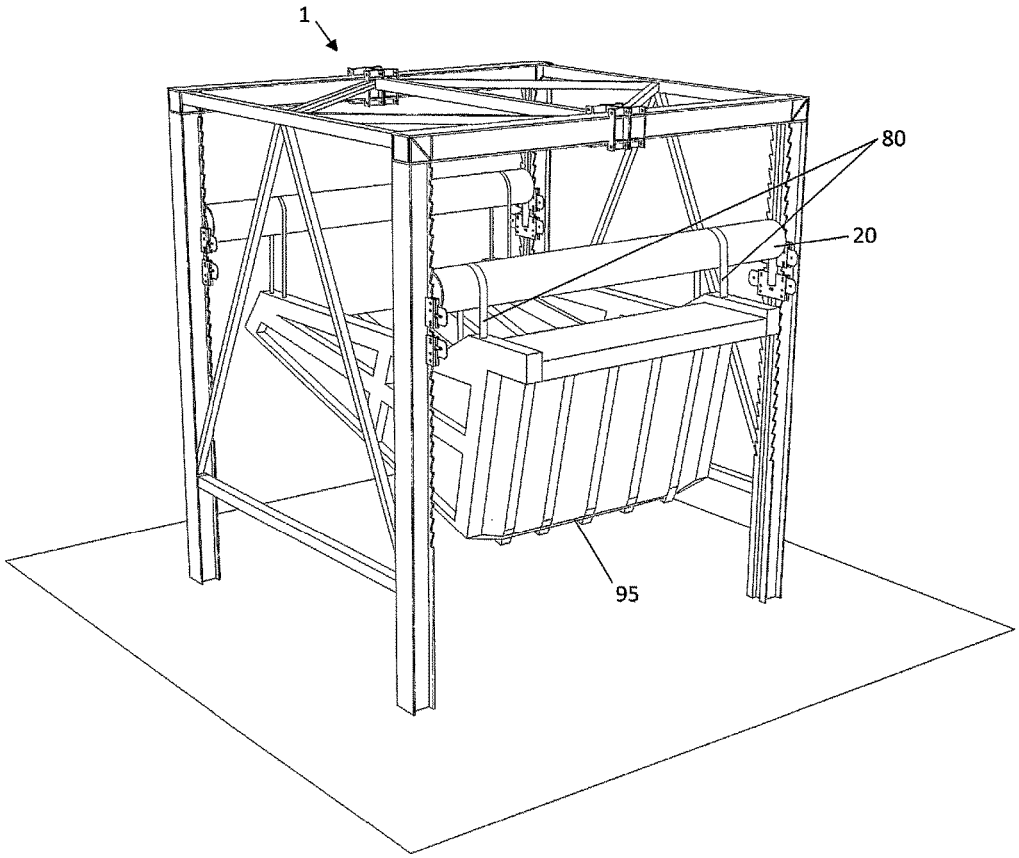
FIG. 27 shows the frame structure lifting a heavy object.

FIG. 27 shows the frame structure 1 lifting a heavy object 95. In this case the heavy object 95 is a hopper. The slings 80 can be seen attaching the heavy object 95 to the rollers 20.

While the invention has been described with reference to specific embodiments, modifications and variations of the invention may be constructed without departing from the scope of the invention, which is defined in the following claims.

We claim:

1. Apparatus comprising:

a structural frame having:

a top, longitudinal sides and first and second open ends, and further comprising:

four spaced pillars having pairs of opposite teeth parallel to the sides of the structural frame, the teeth in each pair being longitudinally spaced, first and second cross beams at tops of the pillars at the first end and at the second end, horizontal beams connecting the cross beams at the top of the structural frame and connecting the pillars at the sides of the structural frame, truss beams connecting the horizontal beams at angles on the top and the sides of the structural frame, climbing assemblies on insides of each of the pillars, each of the climbing assemblies comprising upper and lower plate assemblies, each plate assembly having front plates extending along an inner side of the teeth on a pillar and having back plates behind the teeth on the pillar, each front plate in each of the upper plate assemblies having a roller axle-supporting groove in an upper surface of the front plate, double-acting hydraulic cylinders and piston rods mounted between the upper and lower front plates, each double-acting cylinder connected to one of the upper plates, and each cylinder having a piston rod connected to one of the lower front plates, sliding locks connected to the plates between the front plates and the rear plates of each plate assembly for selectively and concurrently engaging or disengaging the teeth from opposite directions and alternatively locking the upper plates and the lower plates with the locks and the teeth, upper and lower pneumatic actuators connected to the upper and lower plate assemblies and connected to the locks for timely inserting and withdrawing the locks into and out from the teeth, hydraulic lines connected to upper and lower ends of the double-acting cylinders for raising the cylinders and the upper plates when hydraulic pressure is applied to the upper ends of the double-acting cylinders while the lower plates are locked with the teeth, and for raising the lower plates when hydraulic pressure is applied to the lower ends of the hydraulic cylinders while the upper plates are locked with the locks in the teeth, controller operatively connected to valves in the pneumatic lines and to valves in the hydraulic lines for sequencing, inserting the locks and locking all plate assemblies with the pneumatic actuators, withdrawing locks in the upper plate assemblies from the teeth, admitting hydraulic pressure to upper ends of the hydraulic cylinders to raise the upper plate assemblies, inserting locks in the upper plate assemblies into the teeth, withdrawing locks in the lower plates assemblies from the teeth, admitting hydraulic pressure to lower ends of the hydraulic cylinders and raising the lower plate assemblies, and sensors connected to the plate assemblies, actuators, cylinders and pillars and to the controls for providing input to the controller thereby actuating the controls.

2. The apparatus of claim 1, further comprising first and second lifting rollers having axles positioned in the axle-holding grooves in the upper front plates respectively at the first and second ends of the structure.

3. The apparatus of claim 2, wherein the rollers comprise cylinders with end plates at opposite ends, and wherein the axles extend outward from the end plates.

4. The apparatus of claim 2, wherein the rollers comprise cylinders having outer end plates and inner end plates, and wherein the axles are welded to the inner end plates and extend through openings in the outer end plates.

5. The apparatus of claim 4, wherein the axles have annular grooves in ends of the axles opposite the end plates, and wherein the annular grooves in the axles are held in the grooves in the upper front plates.

6. The apparatus of claim 2, further comprising slings extending over the roller and downward therefrom for connecting ends of the slings to an object to be lifted.

7. The apparatus of claim 1, wherein the cylinders and piston rods are provided on axes intersecting the upper and lower plates.

8. The apparatus of claim 1, wherein the front plates further comprise extensions for mounting the pneumatic actuators.

9. The apparatus of claim 1, further comprising sensors on the pillars, pneumatic actuators and hydraulic systems for sensing positions of engaged or disengaged locks.

10. The apparatus of claim 9, wherein the pneumatic actuators comprise double-acting cylinders with pistons and piston rods connected to the locks, wherein the sensors on the pneumatic actuators sense position of the pistons within the pneumatic cylinders, wherein the sensors on the hydraulic systems sense pressure on the hydraulic lines and overforce the hydraulic cylinder and piston for over closing or over opening, and wherein the sensors on the cylinders and lower plate assemblies for sense half travel of the cylinder with respect to the lower plate assemblies for admitting pressure to the pneumatic cylinders to advance the locks for engagement with the teeth.

11. Apparatus comprising:

a structural frame, the structural frame having first and second open ends, first and second longitudinal sides and a top, four spaced pillars at intersections of the sides and ends, cross beams at tops of the pillars at the first and second ends, horizontal beams connecting the cross beams at the top and connecting the pillars at the sides, truss beams connecting the horizontal beams at angles on the top and the sides, plate assemblies connected to the pillars for sliding along inner sides of the pillars, the plate assemblies having roller axle-supporting upward opening grooves in upper surfaces of the plate assemblies, first and second lifting rollers having axles positioned in the axle-holding grooves in the upper front plates respectively at the first and second ends of the structural frame, and lifters connected to the plate assemblies and locks connected to the plate assemblies and to the pillars.

12. The apparatus of claim 11, wherein the rollers comprise cylinders with end plates at opposite ends, and wherein the axles extend outward from the end plates.

13. The apparatus of claim 11, wherein the rollers comprise cylinders having outer end plates and inner end plates, and wherein the axles are welded to the inner end plates and extend through openings in the outer end plates.

14. The apparatus of claim 13, wherein the axles have annular grooves in ends of the axles opposite the end plates, and wherein the annular grooves in the axles are held in the upward opening grooves in the upper front plates.

15. The apparatus of claim 11, further comprising slings extending over the roller and downward therefrom for connecting ends of the slings to an object to be lifted.

16. The apparatus of claim 11, wherein the cylinders and piston rods are provided on axes intersecting the upper and lower plates.

17. The apparatus of claim 11, wherein the front plates further comprise extensions for mounting a plurality of pneumatic actuators for operating the locks.

18. A method comprising:

providing a structural frame having first and second open ends, first and second longitudinal sides and a top, providing four spaced pillars at intersections of the sides and ends, providing cross beams at tops of the pillars at the first and second ends, providing horizontal beams connecting the cross beams at the top and connecting the pillars at the sides, providing truss beams connecting the horizontal beams at angles on the top and the sides, providing plate assemblies connected to the pillars for sliding along inner sides of the pillars, the plate assemblies having inner plates for sliding along insides of the pillars and backing plates connected to the inner plates for holding the inner plates on the pillars, providing roller axle-supporting upward opening grooves in upper surfaces of the plate assemblies, and providing first and second lifting rollers having axles positioned in the axle-holding grooves in the upper front plates respectively at the first and second ends of the structure.

19. The method of claim 18, wherein the rollers comprise cylinders with end plates at opposite ends, and wherein the axles extend outward from the end plates.

20. The method of claim 18, wherein the rollers comprise cylinders having outer end plates and inner end plates, and wherein the axles are welded to the inner end plates and extend through openings in the outer end plates.

21. The method of claim 20, further comprising providing annular grooves in the axles near outer ends of the axles opposite the end plates, and holding the annular grooves in the axles within the grooves in the upper front plates.

22. The method of claim 18, further comprising providing slings extending over the roller and downward therefrom, and connecting ends of the slings to an object to be lifted and lifting the object with the slings.

* * * * *